US009721317B2

(12) United States Patent
Alletto, Jr.

(10) Patent No.: US 9,721,317 B2
(45) Date of Patent: Aug. 1, 2017

(54) PILLOW DISPLAY CART

(71) Applicant: Eugene Alletto, Jr., Glen Head, NY (US)

(72) Inventor: Eugene Alletto, Jr., Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 1016 days.

(21) Appl. No.: 13/944,973

(22) Filed: Jul. 18, 2013

(65) Prior Publication Data

US 2015/0026099 A1 Jan. 22, 2015

(51) Int. Cl.

| | |
|---|---|
| ***G06Q 99/00*** | (2006.01) |
| ***G06Q 90/00*** | (2006.01) |
| ***A47F 7/00*** | (2006.01) |
| *A47B 31/00* | (2006.01) |

(52) U.S. Cl.

CPC ..... *G06Q 90/00* (2013.01); *A47F 7/00* (2013.01); *A47B 2031/004* (2013.01)

(58) Field of Classification Search

CPC ..... G06Q 90/00
USPC ..... 705/500
See application file for complete search history.

(56) References Cited

U.S. PATENT DOCUMENTS 1,772,438 A * 8/1930 Cubberley ..... A47B 65/00 211/11
2,868,391 A * 1/1959 Sides ..... A47F 5/13 211/126.1
3,467,258 A * 9/1969 Larsen ..... A47B 65/00 108/6
3,495,845 A * 2/1970 Jensen ..... B60P 3/20 280/79.2
3,581,935 A * 6/1971 Chi ..... B65H 45/12 221/1
4,066,022 A * 1/1978 Graves ..... A47B 96/02 108/14
4,725,066 A * 2/1988 Nootenboom ..... B62B 3/006 211/126.15
4,958,841 A * 9/1990 Keen ..... A47F 5/13 211/162
5,718,441 A * 2/1998 Kern ..... A47B 57/14 211/187
5,848,798 A * 12/1998 Halvorson, Jr. ..... A47B 31/00 211/134
6,119,873 A 9/2000 Matthews
6,308,837 B1 10/2001 Bragg et al.
6,814,535 B1 * 11/2004 Maness ..... B65G 65/00 414/807
7,159,726 B1 * 1/2007 Stenton ..... A47F 5/0018 211/49.1

(Continued)

OTHER PUBLICATIONS

"Starting a pillow store", gaebler.com, Jun. 2013, 8 total pages.*

*Primary Examiner* — Dennis Ruhl
(74) *Attorney, Agent, or Firm* — Sorell Lenna & Schmidt, LLP

(57) ABSTRACT

A cart for marketing bedding is provided that includes a rack including a plurality of vertical support members and at least one tray positioned between the support members. The tray includes a plurality of compartments. A pillow is disposed in each of the compartments. Each of the pillows has a different configuration. Methods of use are provided.

18 Claims, 10 Drawing Sheets

(56) References Cited

U.S. PATENT DOCUMENTS

| | | | | |
|---|---|---|---|---|
| 7,523,046 | B2 * | 4/2009 | Colalancia | G06Q 10/02 705/7.13 |
| 7,726,735 | B2 | 6/2010 | Resendez | |
| 7,950,537 | B1 * | 5/2011 | Goodman | A47B 57/581 211/184 |
| 8,075,004 | B2 | 12/2011 | Abel et al. | |
| 8,255,291 | B1 * | 8/2012 | Nair | G06F 17/30864 705/26.64 |
| D672,183 | S | 12/2012 | Alletto, Jr. | |
| 8,501,259 | B2 * | 8/2013 | Vergara | A23B 4/062 206/557 |
| 2002/0149176 | A1 * | 10/2002 | Miller | B62B 3/027 280/651 |
| 2004/0201204 | A1 * | 10/2004 | Haire | A61G 1/013 280/639 |
| 2005/0035198 | A1 * | 2/2005 | Wilensky | B62B 3/1424 235/383 |
| 2006/0125356 | A1 * | 6/2006 | Meek, Jr. | A61G 12/001 312/215 |
| 2006/0266770 | A1 * | 11/2006 | Fitzgerald | A61G 12/001 222/137 |
| 2007/0295681 | A1 * | 12/2007 | Colin | A47F 5/12 211/90.03 |
| 2008/0230603 | A1 * | 9/2008 | Stawar | B62B 3/1408 235/383 |
| 2010/0117496 | A1 * | 5/2010 | Clarke | A47B 47/03 312/140.1 |
| 2011/0309591 | A1 | 12/2011 | Petrick et al. | |
| 2014/0070504 | A1 * | 3/2014 | Martin | B62B 3/10 280/47.35 |

* cited by examiner

PILLOW DISPLAY CART

TECHNICAL FIELD

The present disclosure generally relates to carts used to store and display items such as, for example, bedding, and more particularly to a mobile cart for storing and displaying pillows, wherein the cart is adapted for use in a location, such as, for example, a retail store and includes plurality of pillows each having a different configuration. Methods of use are provided.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Mattresses have been developed to suit various sleep preferences and body types. For example, mattresses vary according to certain characteristics, such as, for example, material and firmness so that a person may select a mattress that will achieve maximum spinal alignment, and, in turn, comfort. However, selecting an appropriate mattress alone may not ensure comfortable, restful sleep. Indeed, it is estimated that a proper mattress will only provide about 70% of the spinal alignment needed to achieve maximum comfort. The remaining 30% of the spinal alignment needed to achieve maximum comfort is provided by a pillow.

It is therefore beneficial to select a pillow based on the type of mattress being used, and vice versa. That is, the type of pillow used should be selected based upon, at least in part, the type of mattress used so that the mattress/pillow combination achieves maximum spinal alignment, and hence comfort. However, pillows are typically selected based solely on size or material, for example. Little or no consideration is given to the type of mattress the person uses. This disclosure describes an improvement over these prior art technologies.

SUMMARY

In one embodiment, a cart for storing and marketing bedding is provided. The cart comprises a rack comprising a plurality of vertical support members. At least one tray is positioned between the support members. The tray comprises a plurality of compartments. A pillow is disposed in each of the compartments. Each of the pillows has a different configuration.

In one embodiment, the cart comprises a first pair of vertical support members and a second pair of vertical support members. The support members each extend along a longitudinal axis between a proximal end and a distal end. The distal end of each support member comprises a distal face having a caster coupled thereto. A first upper cross member extends between and connects the proximal ends of the first pair of support members. A second upper cross member extends between and connects the proximal ends of the second pair of support members. A first lower cross member extends between and connects the distal ends of the first pair of support members. A second lower cross member extends between and connects the distal ends of the second pair of support members. A pair of horizontal support members each extend between and connect the proximal end of one of the first pair of vertical support members and the proximal end of one of the second pair of vertical support members. At least one tray is positioned between the first and second pairs of support members. The tray comprises a plurality of spaced apart openings and a plurality of compartments. Adjacent compartments are separated by a wire divider disposed in two of the openings. A pillow is disposed in each of the compartments. The pillows differ from one another with respect to size, material, and shape. The pillows include at least two pillows configured for people that sleep on their stomach, at least two pillows configured for people that sleep on their back and at least two pillows configured for people that sleep on their side.

In one embodiment, a method of marketing bedding is provided. The method includes providing a cart comprising: a rack comprising a plurality of vertical support members, at least one tray positioned between the support members, the tray comprising a plurality of compartments; providing a plurality of pillows, each of the pillows having a different configuration; and positioning one of the pillows in each of the compartments.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
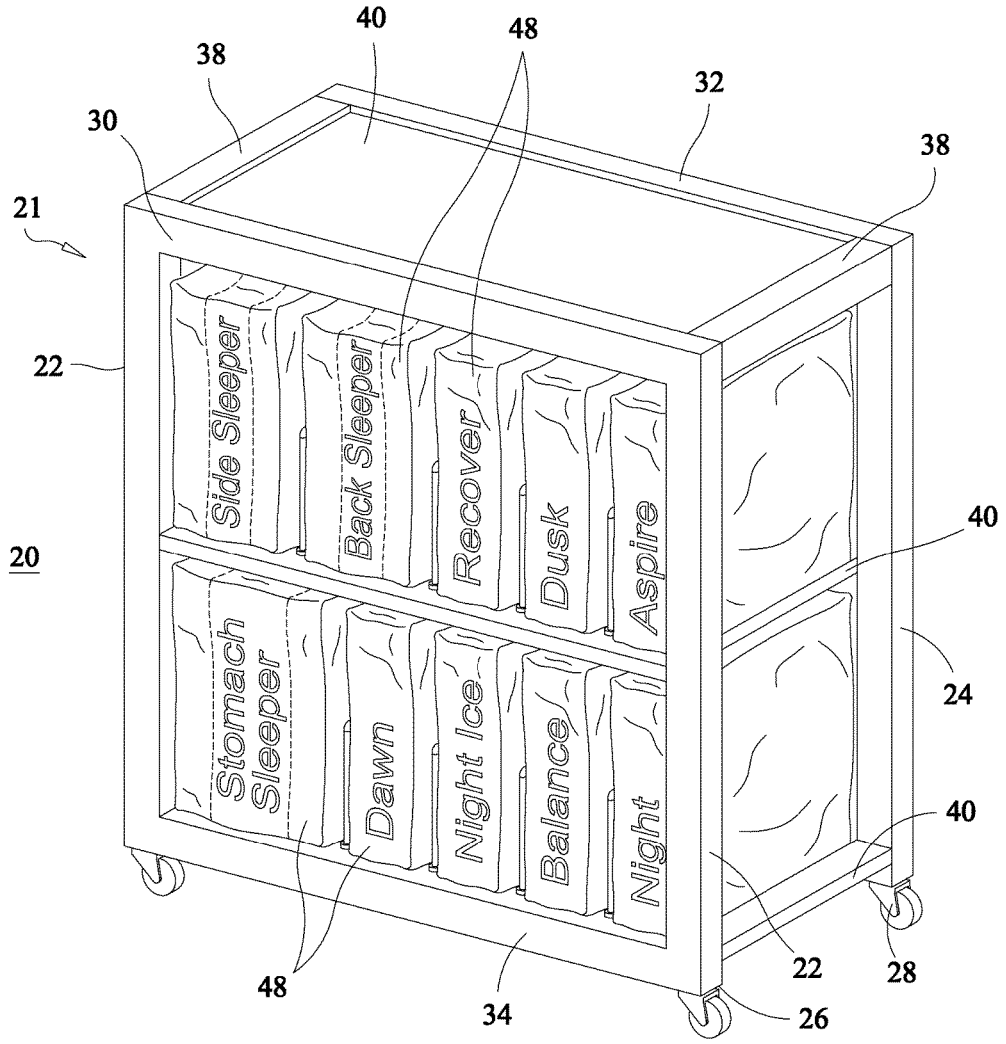
FIG. 1 is a perspective view of one embodiment of a pillow display system in accordance with the principles of the present disclosure.
Figure 2:
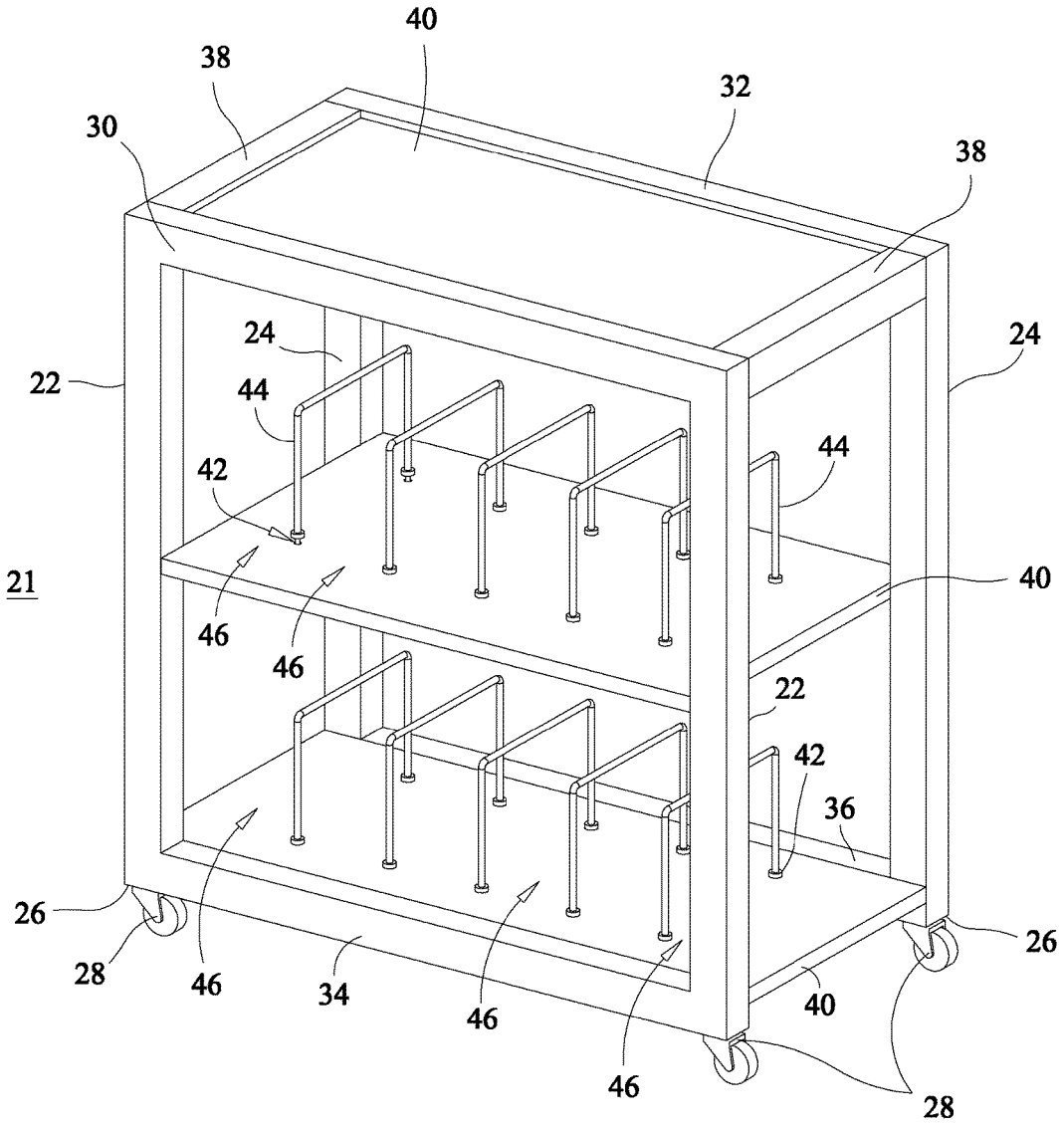
FIG. 2 is a perspective view of a component of the pillow display system shown in FIG. 1.
Figure 3:
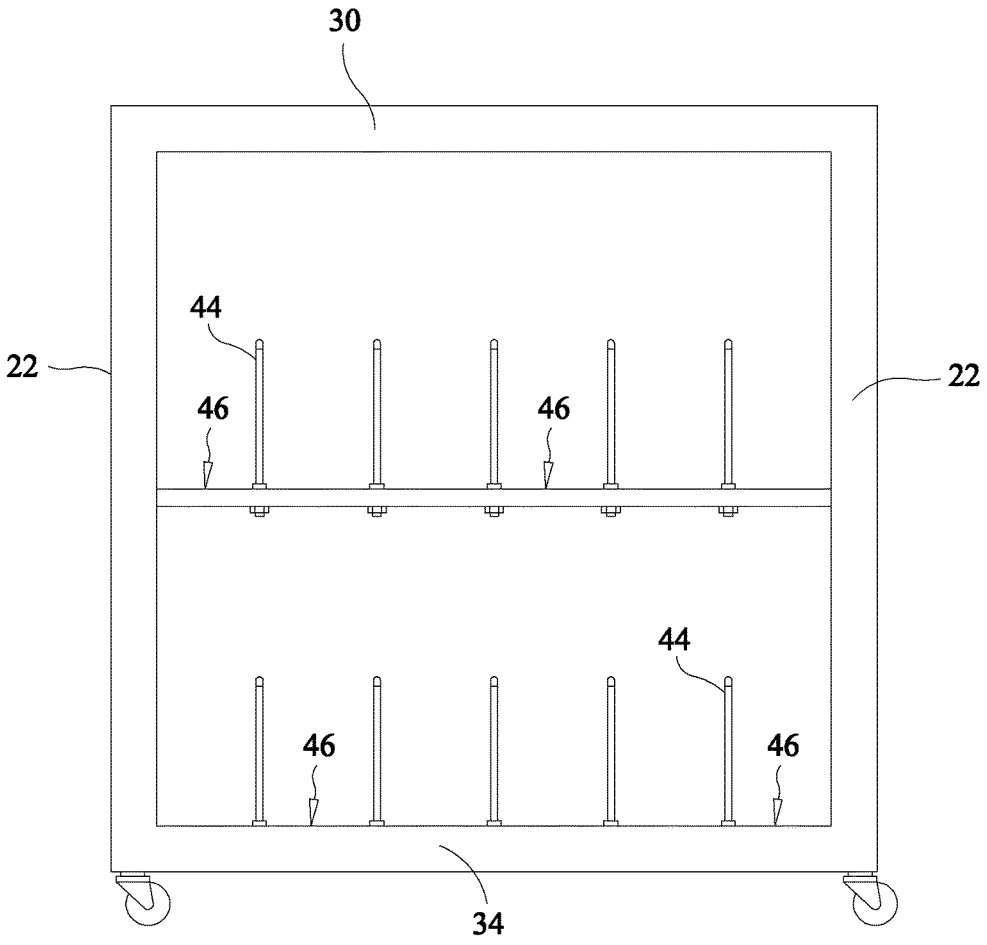
FIG. 3 is a side view of a component of the system shown in FIG. 1.
Figure 4:
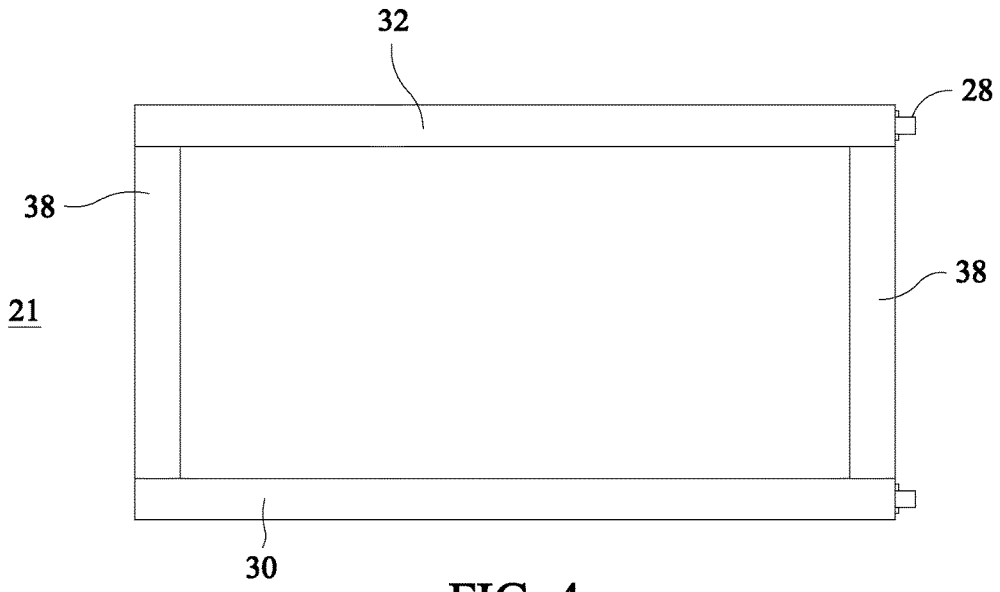
FIG. 4 is a top view of a component of the system shown in FIG. 1.
Figure 5:
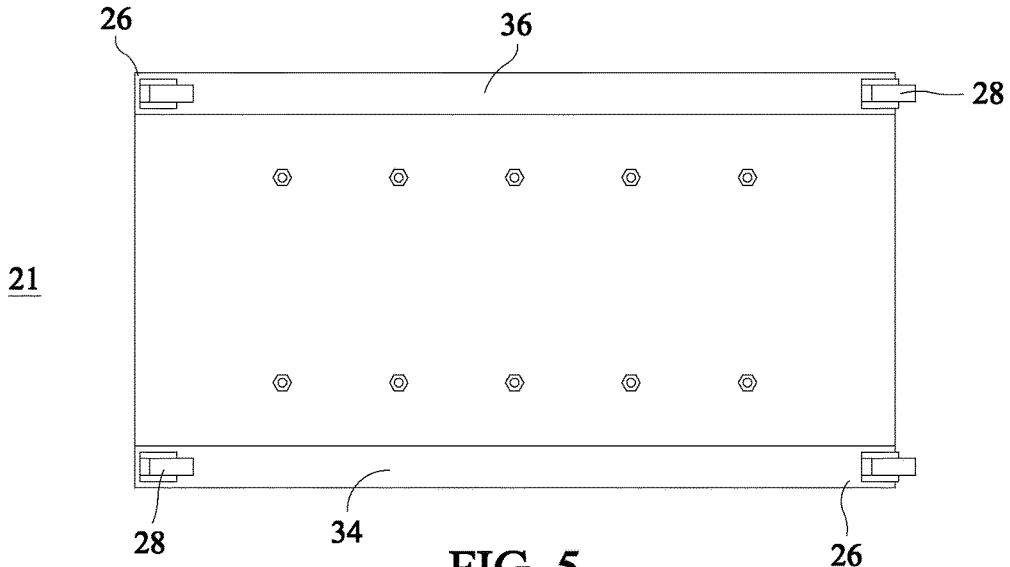
FIG. 5 is a bottom view of a component of the system shown in FIG. 1.
Figure 6:
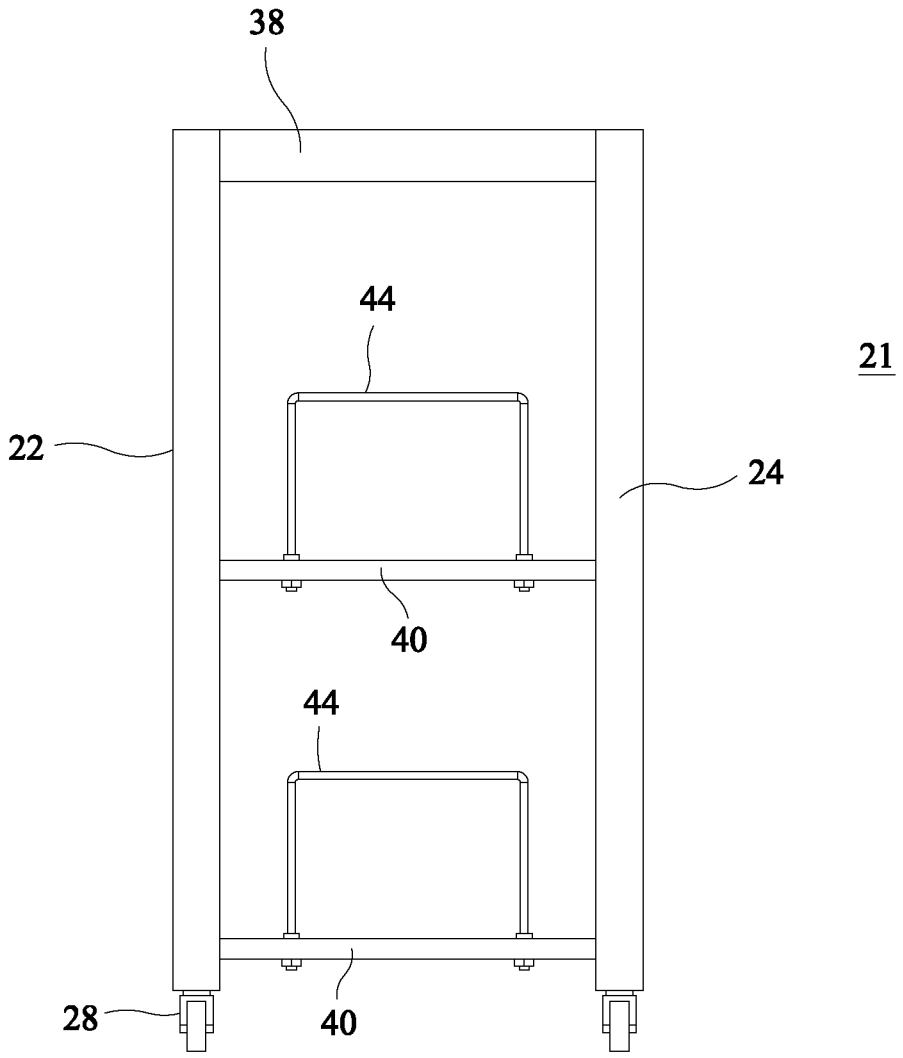
FIG. 6 is an end view of a component of the system shown in FIG. 1.

The exemplary embodiments of a pillow display system and related methods of use are discussed in terms of devices to store and display bedding for marketing purposes. The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a pillow display system, related components and methods of employing the pillow display system in accordance with the principles of the present disclosure. Alternate embodiments are also disclosed. Reference will now be made in detail to the exemplary embodiments of the present disclosure, which are illustrated in the accompanying figures. Turning to FIGS. 1-6, there are illustrated components of a pillow display system 20.

System 20 includes a cart having a plurality of compartments. At least two of the compartments include a pillow disposed therein. In some embodiments, each pillow is disposed in a compartment such that information, such as, for example, a logo, brand name or model name is visible. Each of the pillows has a different configuration. For example, one of the pillows may be configured for people who sleep on their stomach and another pillow may be configured for people who sleep on their back or for people who sleep on their side. The pillows may also be made from different materials, have different sizes, have different shapes and/or include unique characteristics configured to enhance performance. It is envisioned that the cart may include two or more compartments such that the cart holds two or more pillows. In one embodiment, the cart is configured to hold twelve pillows at arm level to facilitate access to each of the pillows for sleep demonstrations and/or comparative testing. In one embodiment, the cart is configured to hold twelve pillows at waist level to facilitate access to each of the pillows for sleep demonstrations and/or comparative testing.

In some embodiments, system 20 is configured for use in a retail store. It is envisioned that system 20 may be used in a retail store that has mattresses in its showroom. In particular, the cart is configured to be moved to a location adjacent at least one of the mattresses in the showroom such that a consumer can lie on the mattress and test each of the pillows included in the cart without having to get up from the mattress or move very far from the mattress. Moreover, the cart can be moved from mattress to mattress, so that the consumer can test each of a plurality of different pillows with a plurality of different mattresses. This allows the consumer to select a pillow that provides the greatest comfort in combination with the mattress being tested so that the consumer may arrive at the mattress/pillow combination that provides optimal spinal alignment, and hence comfort. In some embodiments, the cart includes a plurality of wheels or casters that allow the cart to roll such that the cart is easily movable to different areas of the showroom for positioning adjacent different mattresses, for example, to determine the optimal pillow/mattress combination for a specific consumer.

In some embodiments, the cart comprises a container or dispenser, such as, for example, a cardboard box that includes one or more disposable barriers, such as, for example, sleep napkins that are configured to be placed between a pillow and the consumer's face to avoid contaminating the pillows with dirt and/or oil from the consumer's face as well as to protect the consumer from the same. In one embodiment, the cart holds the box or other container of sleep napkins at waist level to facilitate access to the sleep napkins for sleep demonstrations and comparative testing. In another embodiment, the cart holds the box or other container of sleep napkins above waist level to facilitate access to the sleep napkins for sleep demonstrations and comparative testing.

In some embodiments, the cart includes a section having demonstration jars and/or flasks that is spaced apart from the compartments in which the pillows are disposed. It is envisioned that the jars and/or flasks may include samples of material from which the mattresses and/or pillows are made and/or a means to demonstrate certain performance characteristics of the mattresses and/or the pillows. It is further envisioned that the jars and/or flasks may include samples of material from which a mattress protector that forms a removable barrier configured to prevent contamination of a mattress is made and/or a means to demonstrate certain performance characteristics of the mattress protector. It is contemplated that the cart may include one or a plurality of jars and/or flasks. In some embodiments, the jars and/or flasks are positioned on an upper surface of the cart such that consumers can easily access and manipulate the jars and/or flasks. These jars and/or flasks are designed to be used simultaneously with the sleep napkins as well as an interactive monitor such as an ipad® for demonstration purposes and product information.

In some embodiments, the system includes graphic display signage positioned on or adjacent the cart. In one embodiment, the graphic display signage provides details or instructions that teach a consumer how to choose a pillow among the pillows provided in the cart that will provide the proper spinal alignment in combination with a selected mattress. In one embodiment, the graphic display signage provides details or instructions that teach a consumer how to choose a pillow among the pillows provided in the cart that will improve spinal alignment independent of the mattress used. In some embodiments, the graphic display signage provides information regarding one or more of the pillows provided in the cart, such as, for example, the material or materials used to make each pillow, structural characteristics of each pillow and the benefits provided by each pillow.

In some embodiments, the system includes an interactive device such as, for example, a computer, electronic notebook or electronic tablet such as, for example, an iPad coupled to the cart to provide product information about the pillows provided in the cart. It is envisioned that the interactive device may also provide details or instructions that teach a consumer how to choose a pillow among the pillows provided in the cart that will provide maximum spinal alignment, with or without a particular mattress. It is further envisioned that the interactive device can be configured to provide a side-by-side comparison of two or more of the pillows provided in the cart and/or select a pillow from the pillows provided in the cart that provides a particular consumer with the best spinal alignment based upon data entered into the interactive device by the consumer such as, for example, body weight and/or type and/or the consumer's sleep position preference (stomach sleeper, back sleeper, side sleeper).

The components of system 20 can be fabricated from materials including metals, polymers and/or composites, depending on the particular application. For example, the components of system 20, individually or collectively, can be fabricated from materials such as aluminum, steel, iron, stainless steel, titanium, titanium alloys, cobalt-chrome, stainless steel alloys, semi-rigid and rigid materials, plastics, elastomers, rubbers and/or rigid polymers. Various components of system 20 may have material composites, including the above materials, to achieve various desired characteristics such as strength, rigidity, elasticity, performance and durability. The components of system 20, individually or collectively, may also be fabricated from a heterogeneous material such as a combination of two or more of the above-described materials. The components of system 20 can be extruded, molded, injection molded, cast, pressed and/or machined. The components of system 20 may be monolithically formed, integrally connected or include fastening elements and/or instruments, as described herein.

System 20 includes a cart 21 comprising a first pair of vertical support members 22 extending parallel to one another and a second pair of vertical support members 24 extending parallel to one another. The first pair of vertical support members 22 extend parallel to the second pair of vertical support members 24 such that the first and second pairs of support members 22, 24 define a polygonal cross sectional configuration. Support members 22, 24 each extend along a longitudinal axis between a proximal end and a distal end. The distal ends of each support member 22, 24 includes a distal face 26 having a caster 28 coupled thereto. It is envisioned that casters 28 may be rigid casters, swivel casters, braking casters or locking casters, depending upon the particular application. In one embodiment, casters 28 and vertical support members 22, 24 are integrally formed or monolithic. In some embodiments, casters 28 are coupled to distal faces 26 by frictional engagement, threaded engagement, mutual grooves, screws, adhesive, nails, barbs and/or raised element, depending upon the particular application.

A first upper cross member 30 extends between and connects the proximal ends of support members 22 and a second upper cross member 32 extends between and connects the proximal ends of support members 24. Cross members 30, 32 extend parallel to one another. A first lower cross member 34 extends between and connects the distal ends of support members 22 and a second lower cross member 36 extends between and connects the distal ends of support members 24. Cross members 34, 36 extend parallel to one another. In some embodiments, cross members 30-36 each extend perpendicular to each of the axes.

Support members 22 are integrally formed with cross members 30, 34 and support members 24 are integrally formed with cross members 32, 36. That is, support members 22 and cross members 30, 34 define a unitary first frame portion and support members 24 and cross members 32, 36 define a unitary second frame portion. It is envisioned that the first and second frame portions can have various shape configurations, such as, for example, rectangular, square, polygonal, irregular, uniform, non-uniform, variable and/or tapered, depending upon the particular application. It is envisioned that support members 22 and cross members 30, 34 may be separate components and that support members 24 and cross members 32, 36 may be separate components, wherein the components are connected by frictional engagement, threaded engagement, mutual grooves, screws, adhesive, nails, barbs and/or raised element, depending upon the particular application.

A pair of horizontal support members 38 each extend between and connect the proximal end of one vertical support member 22 and the proximal end of one vertical support member 24. In one embodiment, horizontal support members 38 are integrally formed with vertical support members 22, 24. In some embodiments horizontal support members 38 are connected to vertical support members 22, 24 by frictional engagement, threaded engagement, mutual grooves, screws, adhesive, nails, barbs and/or raised element, depending upon the particular application. In some embodiments, horizontal support members 38 are not included. In some embodiments, cart 21 includes a second pair of horizontal support members (not shown) each extending between and connecting the distal end of one vertical support member 22 and the distal end of one vertical support member 24 such that the second pair of horizontal support members extend parallel to horizontal support members 38.

At least one tray 40 is positioned between the first and second pairs of support members 22, 24 such that tray 40 is positioned between a support member 22 and a support member 24 without being positioned between support members 22, 22 or support members 24, 24. In some embodiments, cart 21 includes at least one tray 40 simultaneously positioned between support members 22, 22 and between support members 24, 24. In some embodiments, cart 21 includes a plurality of spaced apart trays 40. In some embodiments, cart 21 includes at least one tray positioned between a support member 22 and a support member 24 without being positioned between support members 22, 22 or support members 24, 24 and at least one tray 40 simultaneously positioned between support members 22, 22 and between support members 24, 24.

It is envisioned that at least one tray 40 may be positioned at waist level and/or at arm level to facilitate access to items positioned on trays 40 by a consumer or sales representative, for example, while he or she is standing. In some embodiments, at least one tray 40 is positioned at or below waist level to facilitate access to items positioned on the tray 40 by a consumer while he or she is lying on a mattress. In some embodiments, trays 40 are integrally formed with support members 22, 24. In some embodiments, trays 40 are connected to support members 22, 24 by frictional engagement, threaded engagement, mutual grooves, screws, adhesive, nails, barbs and/or raised element, depending upon the requirements of a particular application. In some embodiments, support members 22, 24 each include a projection, such as, for example, a flange such that the projections are aligned vertically; tray 40 rests on the aligned projections such that tray 40 is parallel with cross members 34, 36.

In some embodiments, tray 40 comprises a plurality of spaced apart openings 42. Two openings 42 that define a line extending parallel to horizontal support members 38 have a wire divider 44 disposed therein such that divider 44 also extends parallel horizontal support members 38. In some embodiments, dividers 44 comprise a rigid material that resists bending. In some embodiments, dividers 44 comprise a flexible and/or elastic material. Each divider 44 has a pair of threaded ends that extend through tray 40 and engage a threaded nut to fix divider 44 relative to tray 40. The space between adjacent dividers 44 defines a compartment 46, as does the space between an outermost divider 44 and support members 22, 24. In some embodiments, openings 42 are positioned such that dividers 44 extend at an acute angle relative to horizontal support members 38 to allow items positioned in compartments 46 to be displayed at an angle to show a perspective view of the items, depending upon the requirements of a particular application. In some embodiments, dividers 44 are uniformly spaced to facilitate items of substantially equal size and shape that are placed in compartments 46. In some embodiments, the space between adjacent dividers is non-uniform to accommodate items in compartments having different sizes and shapes.

A pillow 48 is positioned in at least two of compartments 46. In some embodiments, a pillow is positioned in each of compartments 46. In some embodiments, pillows 48 are positioned in compartments such that indicia on pillows 48, such as, for example, a brand or model name or marketing information attached to pillows 48 such as, for example, a tag is viewable from an exterior of cart 21. This allows a consumer to identify each pillow 48 and/or read marketing information regarding each pillow 48 without removing a respective pillow 48 from a respective compartment 46. Each of pillows 48 have a different configuration. For example, it is envisioned that pillows 48 may differ from one another with respect to size, material, and/or shape. It is envisioned that cart 21 may include at least one pillow 48 having a filler comprising latex, at least one pillow 48 having a filler comprising memory foam, at least one pillow 48 having a filler comprising a gel and/or at least one pillow having a filler comprising a down-alternative hypoallergenic material.

In some embodiments, at least one of pillows 48 has gusseted sides and at least one of pillows 48 does not. It is envisioned that the gusseted sides may comprise a breathable fabric that is different than the material(s) that comprise the remaining portions of a respective pillow 48. In some embodiments, at least one of pillows 48 has gusseted sides positioned between front and back panels that are not gusseted and at least one of pillows 48 does not. In some embodiments, at least one of pillows 48 has gusseted sides positioned between front and back panels, wherein at least one of the front and back panels is also gusseted and at least one of pillows 48 does not. In some embodiments, at least one of pillows 48 has a removable core and at least one of pillows 48 does not. In some embodiments, at least one of pillows 48 has a shell including a zipper along a front bottom edge and removable core disposed within the shell and at least one of pillows 48 does not. In some embodiments, at least one of pillows 48 has a self-leveling core and at least one of pillows 48 does not. In some embodiments, at least one of pillows 48 has a shock absorber core comprising visco-memory foam and gel fiber and at least one of pillows 48 does not. In some embodiments, at least one of pillows 48 has a latex core that is blended with gel-fiber clusters and at least one of pillows 48 does not. In some embodiments, at least one of pillows 48 has a resilient core and at least one of pillows 48 does not. In some embodiments, at least one of pillows 48 has metallic corded seams and at least one of pillows 48 does not. In some embodiments, at least one of pillows 48 has metallic corded seams and gusseted sides and at least one of pillows 48 does not. In some embodiments, at least one of pillows 48 comprises a moisture-wicking, stain-resistant fabric, such as, for example, Dri-Tec® sold by Bedgear™ of Farmingdale, N.Y. (see bedgear.com, the contents of which are incorporated herein by reference), and at least one of pillows 48 does not. In some embodiments, at least one of pillows 48 comprises a solid latex and solid memory foam blend and at least one of pillows 48 does not. In some embodiments, at least one of pillows 48 has mesh sidewalls and at least one of pillows 48 does not. In some embodiments, at least one of pillows 48 has mesh sidewalls and a filter fabric behind the mesh sidewalls and at least one of pillows 48 does not. In some embodiments, at least one of pillows 48 has a liquid layer and at least one of pillows 48 does not.

People tend to sleep on their stomach, back or side. When people sleep on their stomach, their shins make contact with the mattress and their body weight is evenly distributed. Adequate support under the person's hips keeps his or her body aligned. A pillow for people that sleep on their stomach must therefore support the person's head and neck for proper spinal alignment. When people sleep on their back, the backs of their legs make contact with a comfort layer of the mattress such that that the person's body weight is evenly distributed. Adequate support under the person's hips keeps his or her body aligned. A pillow for people that sleep on their back must therefore support the person's head and neck for proper spinal alignment. When people sleep on their side, their hips are aligned with the rest of his or her body and his or her shoulders sink into a comfort layer of the mattress. A pillow for people that sleep on their side must therefore support the person's head and neck for proper spinal alignment.

In some embodiments, cart 21 includes at least two pillows 48 configured for people that sleep on their stomach, at least two pillows 48 configured for people that sleep on their back and at least two pillows 48 configured for people that sleep on their side. It is envisioned that at least one of the pillows 48 configured for people that sleep on their stomach differs with respect to size, shape, or material relative to another pillow 48 configured for people that sleep on their stomach; at least one of the pillows 48 configured for people that sleep on their back differs with respect to size, shape, or material relative to another pillow 48 configured for people that sleep on their back; and at least one of the pillows 48 configured for people that sleep on their side differs with respect to size, shape, or material relative to another pillow 48 configured for people that sleep on their side.

In some embodiments, pillows 48 include at least one pillow 48 with a mesh gusset, as shown in U.S. Pat. No. D672,183, which issued as a United States Design Patent on Dec. 11, 2012, the contents of which are incorporated herein by reference. In some embodiments, pillows 48 include at least one pillow 48 with a mesh gusset, as shown in U.S. Pat. No. D672,184, which issued as a United States Design Patent on Dec. 11, 2012, the contents of which are incorporated herein by reference. In some embodiments, pillows 48 include at least one pillow 48 with a mesh gusset, as shown in U.S. Pat. No. D672,186, which issued as a United States Design Patent on Dec. 11, 2012, the contents of which are incorporated herein by reference.

Figure 7:
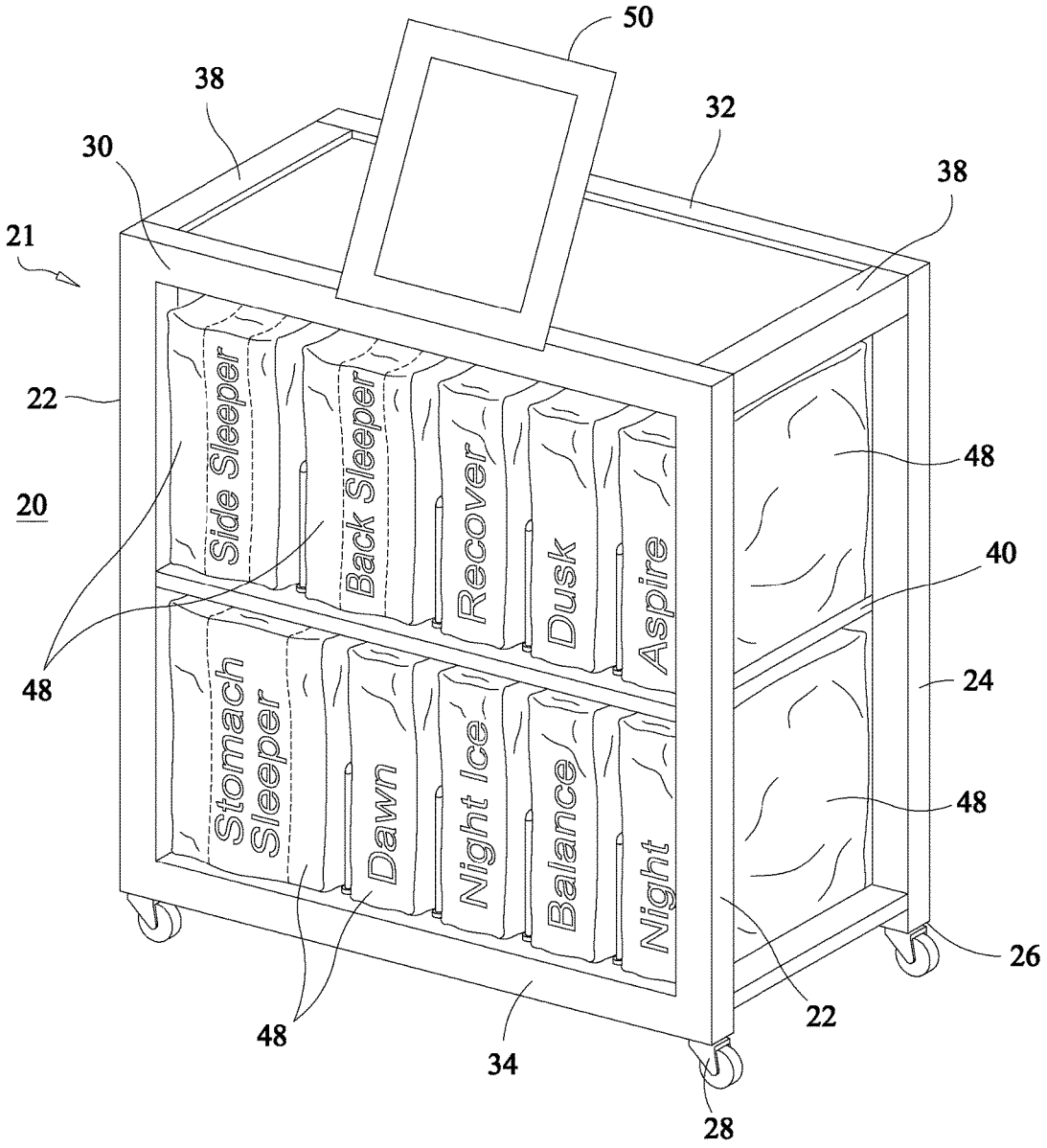
FIG. 7 is a perspective view of one embodiment of a pillow display system in accordance with the principles of the present disclosure.

In one embodiment, shown in FIG. 7, system 20 includes an interactive device 50, such as, for example a computer tablet device, iPad, iPod, electronic reader device (e-Reader), personal data assistant (PDA), computer notebook device or smart phone. In some embodiments, interactive device 50 includes a keyboard, a touch screen, or both. In some embodiments, interactive device 50 is coupled to cart 21 by a bracket, for example. It is envisioned that the bracket may be fixed to cart 21 such that the bracket allows interactive device 50 to pivot relative to cart 21. In some embodiments, interactive device 50 is fixed to cart 21. It is envisioned that interactive device 50 may be positioned anywhere relative to cart 21. For example, interactive device 50 may be coupled to cross member 30, cross member 32, cross member 34, cross member 36, support members 38 or trays 40. In some embodiments, an uppermost tray 40 comprises a surface onto which interactive device 50 may be removably placed.

In some embodiments, interactive device 50 includes information regarding each of pillows 48, such as, for example, information regarding available sizes, fabric/material(s) and/or features. In some embodiments, interactive device 50 includes information regarding a plurality of mattresses. It is envisioned that interactive device 50 may be configured to select a pillow 48 that provides maximum spinal alignment head and neck support, and open air passage when used in combination with a specific type of mattress by a person having a specific body type and/or sleep position preference (e.g., side sleeper). It is further envisioned that interactive device 50 may be configured to provide a side-by-side comparison of two or more of pillows 48 positioned in compartments 46.

Figure 8:
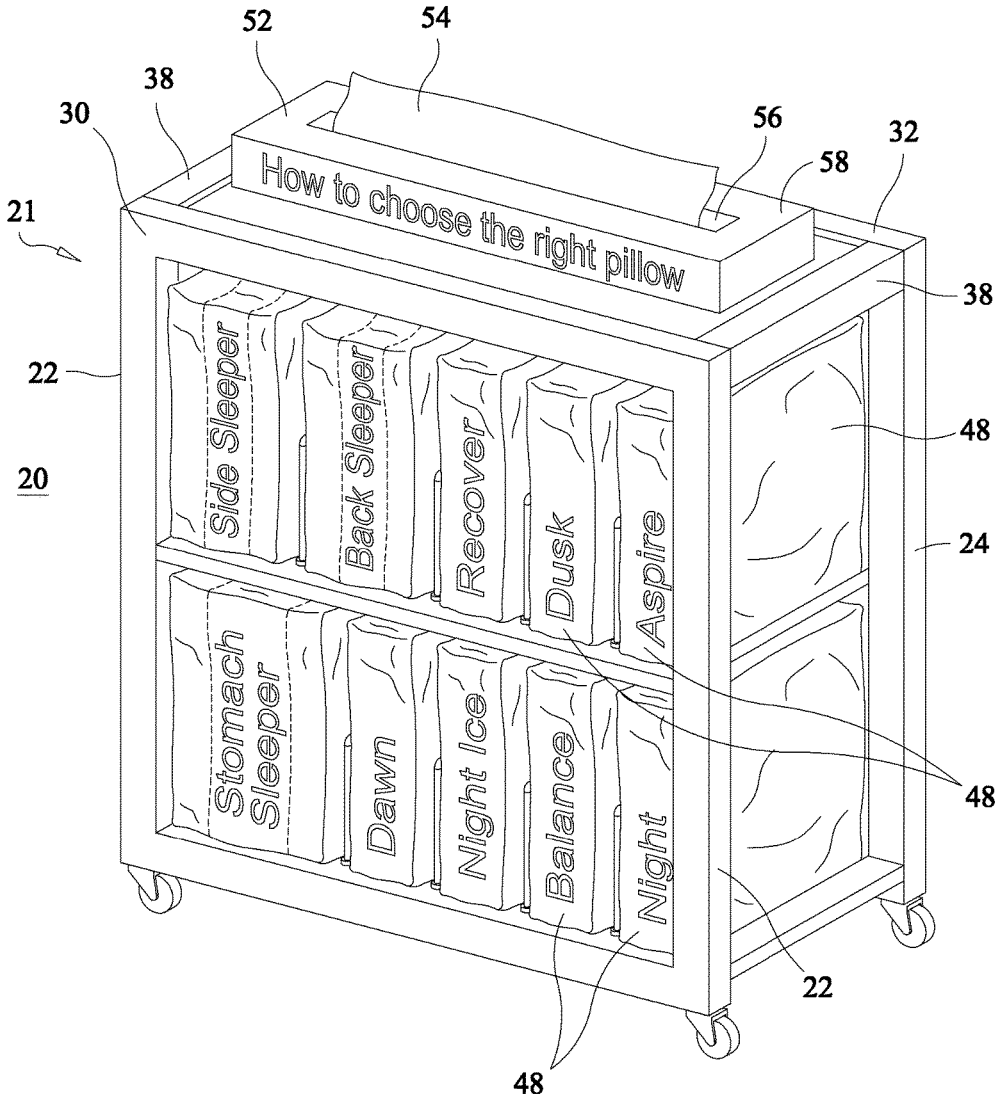
FIG. 8 is a perspective view of one embodiment of a pillow display system in accordance with the principles of the present disclosure.

In one embodiment, shown in FIG. 8, system 20 includes a dispenser 52 that includes one or more disposable barriers, such as, for example, disposable pillow covers 54 configured to cover at least a portion of each pillow 48. In some embodiments, dispenser 52 has a substantially rectangular configuration and includes a substantially rectangular opening 56 extending through an upper surface 58 of dispenser 52. It is envisioned that dispenser 52 and/or opening 56 may have various shape configurations, such as, for example, square, circular, oval, oblong, polygonal, irregular, uniform, non-uniform, variable and/or tapered, depending upon the requirements of a particular application. It is further envisioned that opening 56 may extend through any surface of dispenser 52, such as, for example a side surface or an end surface. An inner surface of dispenser 52 defines a cavity having disposable pillow covers 54 disposed therein. In some embodiments, dispenser 52 includes indicia printed on an exterior surface thereof, such as, for example, indicia that teaches a consumer how to choose the pillow 48 that will provide the best spinal alignment based upon the mattress he or she uses and/or his or her body type and/or sleep position preference.

In some embodiments, disposable pillow covers 54 are in the form of a roll. In some embodiments, disposable pillow covers 54 are in the form of a roll that is wound about a spool and cart 21 includes a bracket configured to engage the spool such that the spool is rotatable relative to cart 21. In some embodiments, disposable pillow covers 54 are stacked on top of one another. In some embodiments, there are perforations between adjacent disposable pillow covers 54 to permit a single disposable pillow cover 54 to be separated from the remaining disposable pillow covers 54 without cutting the same with a scissor or other cutting means. In some embodiments, disposable pillow cover 54 is formed from a single unperforated sheet and dispenser 52 includes a cutting means, such as, for example, a serrated edge configured to cut a selected length of disposable pillow cover 54 from the sheet.

In one embodiment, dispenser 52 is removably placed on a top surface of an uppermost tray 40. In some embodiments, cart 21 includes a bracket that is fixed to cart 21 and dispenser 52 is coupled to the bracket. In some embodiments, dispenser 52 is removably disposed in a compartment 46. In some embodiments, dispenser 52 is configured to be positioned at waist level.

Figure 9:
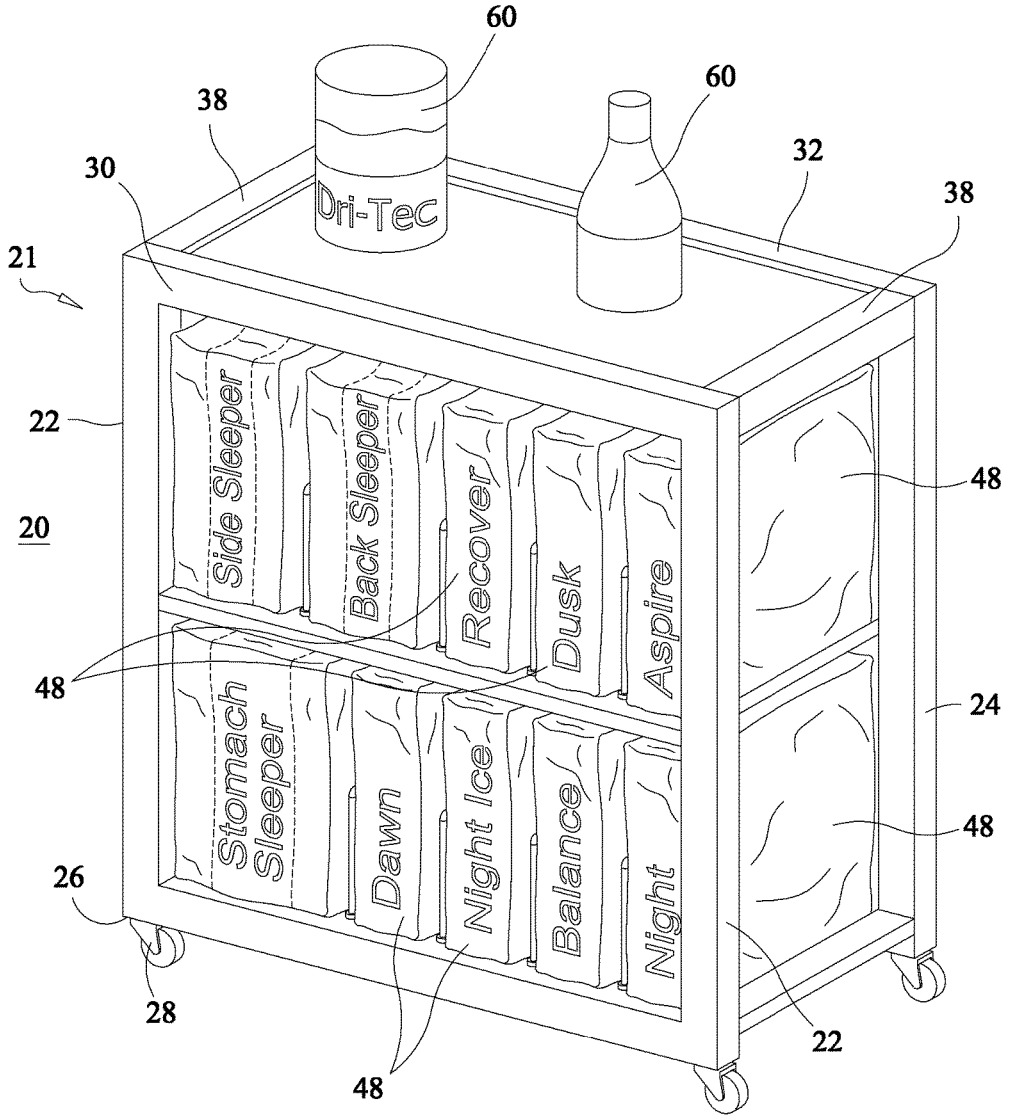
FIG. 9 is a perspective view of one embodiment of a pillow display system in accordance with the principles of the present disclosure.

In one embodiment, shown in FIG. 9, system 20 includes one or more flasks or jars 60 removably placed on a top surface of an uppermost tray 40. In some embodiments, jars 70 are removably disposed in at least one compartment 46. It is envisioned that jars 60 may include samples of material from which pillows 48 are made and/or a means to demonstrate certain performance characteristics of pillows 48.

Figure 10:
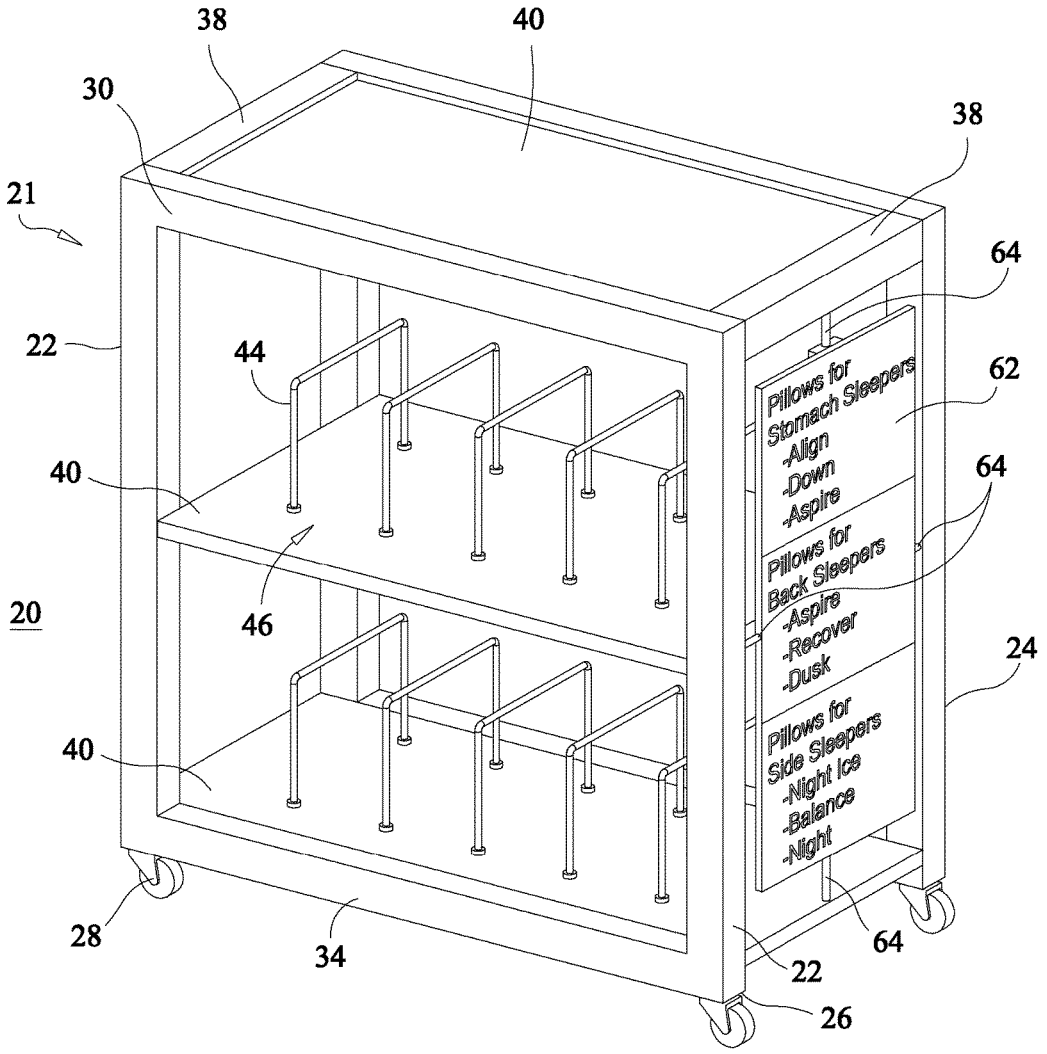
FIG. 10 is a perspective view of a component of one embodiment of a pillow display system in accordance with the principles of the present disclosure.
Figure 12:
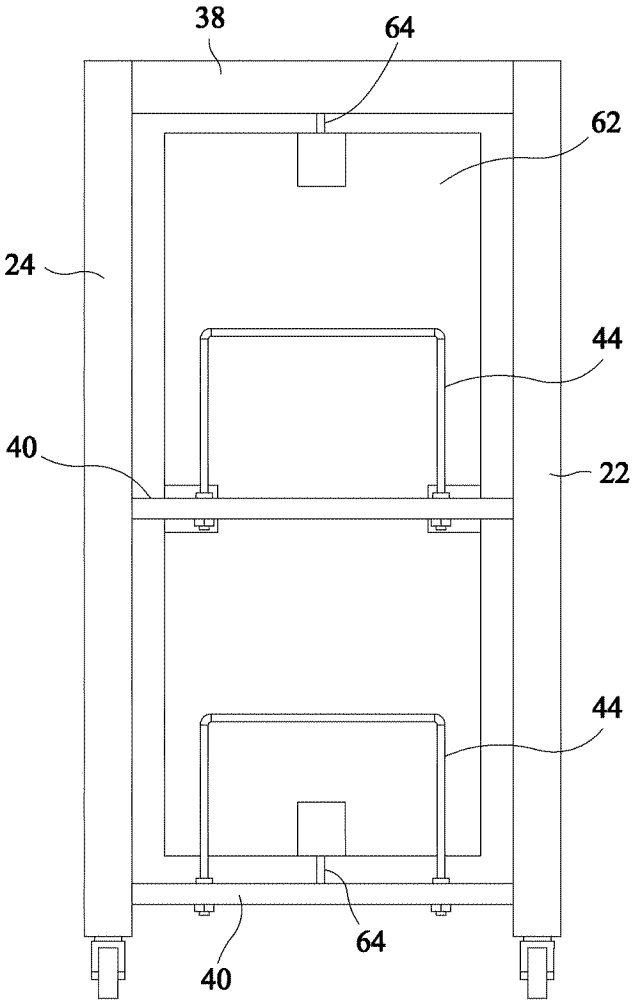
FIG. 12 is an end view of the component shown in FIG. 9.
Figure 11:
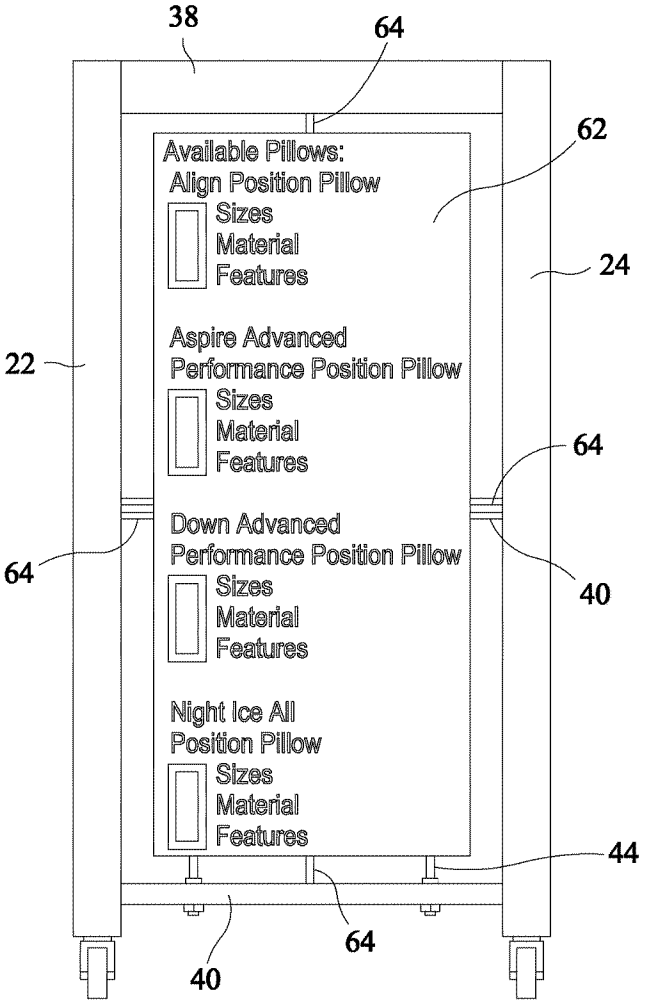
FIG. 11 is an end view of the component shown in FIG. 9.

In one embodiment, shown in FIGS. 10-12, cart 21 includes graphic display signage 62 positioned such that signage 62 is visible from an exterior of cart 21. In some embodiments, signage 62 is positioned at one end of cart 21, between a support member 22 and an adjacent support member 24 and between a support member 38 and a tray 40, as shown in FIG. 10. In one embodiment, the support member 22, the support member 24 and the tray 40 that signage 62 is positioned between each include a mounting brace 64 that engages one side of signage 62 such that signage 62 is positioned between braces 64. It is envisioned that signage 62 may be positioned anywhere relative to cart 21. For example, signage 62 may be coupled to cross member 30, cross member 32, cross member 34, cross member 36, one of support members 38 or one of trays 40.

Signage 62 provides details or instructions that teach a consumer how to choose a pillow from pillows 48 that will provide the proper spinal alignment in combination with a selected mattress. In one embodiment, signage 62 provides details or instructions that teach a consumer how to choose a pillow from pillows 48 that will provide maximum spinal alignment independent of the mattress used. In some embodiments, signage 62 provides information regarding one or more of pillows 48, such as, for example, the material or materials used to make each pillow 48, structural characteristics of each pillow 48 and the benefits provided by each pillow 48.

In operation and use, cart 21 is positioned adjacent a bed or mattress in a store showroom or other location. In one embodiment, cart 21 is rolled from a remote location to a location adjacent one or more mattresses. Prior to selecting one of pillows 48 from compartments 46, a consumer may choose to read information about pillows 48 on interactive device 50, dispenser 52, jar 60 and/or signage 62 to assist in making their selection. The consumer may then select one of pillows 48 based on such information and remove the selected pillow 48 from a respective compartment 48. For example, in some embodiments, interactive device 50 includes an icon representing each of pillows 48. Selecting one of the icons provides information about the pillow 48 the icon represents. The consumer may then select one of pillows 48 based on such information and remove the selected pillow 48 from a respective compartment 48.

In some embodiments, the consumer may navigate an interface, such as, for example a touchscreen or keyboard of interactive device 50, and select an icon on interactive device 50 representing one of pillows 50 such that interactive device 50 provides information regarding the selected pillow 48. It is envisioned that after reading information on interactive device 50 regarding the selected pillow 48, the consumer may then select another icon on interactive device representing a second pillow 48 such that interactive device 50 provides information regarding the second selected pillow 48. Interactive device 50 may then provide a side by side comparison of the selected pillow 48 and the second selected pillow 48 on interactive device 50. The consumer may then select one of pillows 48 based on such a comparison and remove the selected pillow 48 from a respective compartment 48.

In addition to or as an alternative to reading and/or comparing information about pillows 48 on interactive device 50, dispenser 52, jar 60 and/or signage 62, the consumer may enter personal information into interactive device 50 such as, for example, his or her height, weight and/or sleep position preference, which will prompt interactive device 50 to present information on a display relating to pillows 48 that would provide proper spinal alignment based on the information the consumer input into interactive device 50. The consumer may then select one of pillows 48 based on such information and remove the selected pillow 48 from a respective compartment 48.

Prior to testing the selected pillow 48, the consumer may obtain a single disposable pillow cover 54 from dispenser 52. The selected pillow 48 may then be placed on top of the mattress, with the single disposable pillow cover 54 placed on top of the selected pillow 48. The consumer may then lie on the mattress and test the selected pillow 48 to determine if it provides proper spinal alignment in combination with the mattress. The consumer may then lie on the mattress and/or move around on the mattress to determine if the selected pillow 48 is comfortable to the consumer.

The process discussed in the preceding paragraphs may then be repeated with other pillows 48. For example, the consumer may remove the selected pillow 48 from the mattress and select another pillow 48 from one of compartments 46. It is envisioned that the second selected pillow 48 may be positioned at a level that allows the consumer to pull the second selected pillow 48 from cart 21 while lying on the mattress, without standing. Prior to testing the second selected pillow 48, the consumer may obtain another disposable pillow cover 54 from dispenser 52. It is envisioned that dispenser 52 will be positioned at a level such that the consumer can obtain a disposable pillow cover 54 from dispenser 52 while lying on the mattress, without standing or the salesperson can obtain a disposable pillow cover 54 and hand it to the consumer while the consumer in lying on the mattress. The second selected pillow 48 may then be placed on top of the mattress, with the second disposable pillow cover 54 placed on top of the second selected pillow 48. The consumer may then lie on the mattress and test the second selected pillow 48 to determine if it provides proper spinal alignment in combination with the mattress. The consumer may then lie on the mattress and/or move around on the mattress to determine if the second selected pillow 48 is comfortable to the consumer. In some embodiments, the disposable pillow cover 54 used to test the first selected pillow 48 may also be used to test the second selected pillow 48 as well as additional pillows 48.

The consumer may then compare the first and second selected pillows 48 based on his or her experience. This process can be repeated with any number of pillows 48. It is envisioned that after comparing a desired number of pillows 48, the consumer will purchase the pillow 48 that he or she believes is most comfortable.

In some embodiments, cart 21 is positioned adjacent a second mattress in the same store showroom, the second mattress being spaced apart from the first mattress discussed in the preceding paragraphs. The consumer may then select one of pillows 48 and remove the selected pillow 48 from a respective compartment 48.

The consumer may then lie on the second mattress and test the selected pillow 48 to determine if it provides proper spinal alignment in combination with the second mattress by placing the selected pillow 48 on the second mattress such that the selected pillow 48 is positioned between the second mattress and the consumer's head. The consumer may then lie on the second mattress with his or head on the selected pillow 48 and stay stationary and/or move around on the second mattress to determine if the selected pillow 48 is comfortable to the consumer. This process may then be repeated with other pillows 48. For example, the consumer may remove the selected pillow 48 from the second mattress and select another pillow 48 from one of compartments 46. The consumer may then lie on the second mattress and test the second selected pillow 48 to determine if it provides proper spinal alignment in combination with the second mattress by placing the second selected pillow 48 on the mattress such that the second selected pillow 48 is positioned between the second mattress and the consumer's head. The consumer may then lie on the second mattress with his or head on the second selected pillow 48 and stay stationary and/or move around on the second mattress to determine if the second selected pillow 48 is comfortable to the consumer. The consumer may then compare the tested pillows 48 based on his or her experience. This allows the consumer to choose a pillow 48 that provides the best spinal alignment, and hence optimal comfort, in combination with a selected mattress. This process can be repeated with any number of pillows 48 and/or mattresses. It is envisioned that after comparing a desired number of pillows 48, the consumer will purchase the pillow 48 that he or she believes is most comfortable and/or a mattress and pillow 48 combination that he or she believes is most comfortable. It is further envisioned that disposable pillow covers 54 may be used to test pillows 48 with the second mattress in the same manner as disposable pillow covers 54 were used to test pillows 48 with the first mattress.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A system for marketing bedding, the system comprising:

a cart comprising:

a rack comprising a plurality of vertical support members, first and second cross members that each extend between and connect two of the vertical support members and a pair of horizontal support members that each extend between and connect the cross members and two of the vertical support members, and at least one tray positioned between the support members, the tray comprising a plurality of compartments, the cart comprising an upper mounting bracket coupled to one of the horizontal support members and a lower mounting bracket coupled to the at least one tray; and a pillow disposed in each of the compartments, each of the pillows having a different configuration, wherein signage engages the mounting brackets to couple the signage to the rack, the signage comprising information about the pillows.

2. A system as recited in claim 1, wherein at least two of the pillows differ with respect to size.

3. A system as recited in claim 1, wherein at least two of the pillows differ with respect to material.

4. A system as recited in claim 1, wherein the pillows include at least one pillow having a filler comprising latex, at least one pillow having filler comprising memory foam.

5. A system as recited in claim 1, wherein at least two of the pillows differ with respect to shape.

6. A system as recited in claim 1, wherein at least one of the pillows has gusseted sides and at least one of the pillows does not.

7. A system as recited in claim 1, wherein at least one of the pillows has a removable core and at least one of the pillows does not.

8. A system as recited in claim 1, wherein the pillows include at least one pillow that differs in size and shape relative to at least one of the other pillows.

9. A system as recited in claim 1, wherein at least one of the pillows differs with respect to size, shape, or material relative to another of the pillows.

10. A system as recited in claim 1, wherein adjacent compartments are separated by a wire divider.

11. A system as recited in claim 1, further comprising a a dispenser disposed positioned on top of the cart, the dispenser comprising a plurality of disposable pillow covers.

12. A system as recited in claim 1, further comprising an interactive device that provides information regarding each of the pillows, the interactive device being coupled to the cart.

13. A system as recited in claim 1, wherein the signage comprises information about materials used to make each of the pillows.

14. A system as recited in claim 1, wherein the signage comprises information about structural characteristics of each of the pillows.

15. A system as recited in claim 1, wherein the signage comprises information about benefits provided by each of the pillows.

16. A system as recited in claim 1, wherein casters are coupled to a distal end of each of the vertical support members such that the casters intersect axes defined by the vertical support members.

17. A system as recited in claim 1, wherein the at least one tray is integrally formed with the vertical support members.

18. A system for marketing bedding, the system comprising:

a cart comprising:

a first pair of vertical support members, a second pair of vertical support members, the support members each extending along a longitudinal axis between a proximal end and a distal end, the distal ends of each support member comprising a distal face having a caster coupled thereto;

a first upper cross member extending between and connecting the proximal ends of the first pair of support members, a second upper cross member extending between and connecting the proximal ends of the second pair of support members, a first lower cross member extending between and connecting the distal ends of the first pair of support members, a second lower cross member extending between and connecting the distal ends of the second pair of support members, a pair of horizontal support members each extending between and connecting the proximal end of one of the first pair of vertical support members and the proximal end of one of the second pair of vertical support members, an upper mounting bracket coupled to one of the horizontal support members, at least one tray positioned between the first and second pairs of support members, the tray comprising a plurality of compartments, adjacent compartments being separated by a wire divider, and a lower mounting bracket coupled to the at least one tray; and a pillow disposed in each of the compartments, the pillows differing from one another with respect to size, material, and shape, wherein signage engages the mounting brackets to couple the signage to the rack, the signage comprising information about the pillows.

* * * * *